US012565748B2

(12) United States Patent
Weissberg et al.

(10) Patent No.: US 12,565,748 B2
(45) Date of Patent: Mar. 3, 2026

(54) PROTECTION DEVICE AGAINST TRUCK RAMMING ATTACKS

(71) Applicant: PITAGONE, Brussels (BE)

(72) Inventors: Marc Weissberg, Brussels (BE); Shimon Bretholz, Kfar Saba (IL)

(73) Assignee: PITAGONE, Brussels (BE)

( * ) Notice: Subject to any disclaimer, the term of this patent is extended or adjusted under 35 U.S.C. 154(b) by 601 days.

(21) Appl. No.: 17/421,324

(22) PCT Filed: Jan. 29, 2020

(86) PCT No.: PCT/EP2020/052108
§ 371 (c)(1),
(2) Date: Jul. 7, 2021

(87) PCT Pub. No.: WO2020/157101
PCT Pub. Date: Aug. 6, 2020

(65) Prior Publication Data

US 2022/0056652 A1 Feb. 24, 2022

(30) Foreign Application Priority Data

Jan. 30, 2019 (EP) ..... 19154548

(51) Int. Cl.
*E01F 13/12* (2006.01)
*F41H 11/08* (2006.01)

(52) U.S. Cl.
CPC ..... *E01F 13/12* (2013.01); *F41H 11/08* (2013.01)

(58) Field of Classification Search
None
See application file for complete search history.

(56) References Cited

U.S. PATENT DOCUMENTS 90,232 A * 5/1869 Brinly ..... A01B 15/08 172/736
2,738,394 A * 3/1956 Matthews ..... H01H 75/04 188/85

(Continued)

FOREIGN PATENT DOCUMENTS

CH 446125 A 10/1967
CN 201842267 U * 5/2011

(Continued)

OTHER PUBLICATIONS

International Search Report and Written Opinion of the International Searching Authority from the European Patent Office, in PCT/EP2020/052108 dated Mar. 26, 2020, which is an international application corresponding to this U.S. application.

*Primary Examiner* — Christopher J Sebesta
*Assistant Examiner* — Katherine J Chu
(74) *Attorney, Agent, or Firm* — Kolitch Romano Dascenzo Gates LLP

(57) ABSTRACT

An anti-ramming truck barrier element may include: an essentially horizontal arresting bar, and an essentially vertical pivot bar. The vertical pivot bar has at least three fasteners distributed along the length of each side. The arresting bar is rigidly connected to the pivot bar. Connecting bars are pivotably connected to the side of the pivot bar, and are being adapted to be cross-connected at different crossing angles to adjacent pivot bars, using the at least three fasteners distributed along the length of each side of the pivot bar.

20 Claims, 2 Drawing Sheets

(56) References Cited

U.S. PATENT DOCUMENTS

| | | | | |
|---|---|---|---|---|
| 4,481,748 | A * | 11/1984 | D'Alessio | E04G 1/12 182/186.6 |
| 5,114,266 | A * | 5/1992 | Cocina, Jr. | E01F 15/0461 404/6 |
| 5,549,410 | A | 8/1996 | Beryozkin et al. | |
| 5,775,832 | A | 7/1998 | Kilgrow et al. | |
| 6,237,753 | B1 * | 5/2001 | Walter | B65G 15/62 198/840 |
| 10,415,198 | B1 | 9/2019 | Thomas | |
| 10,724,191 | B2 | 7/2020 | Pan | |
| 2010/0290833 | A1 | 11/2010 | Whitford | |
| 2012/0177439 | A1 | 7/2012 | More et al. | |
| 2014/0161523 | A1 | 6/2014 | Ball | |
| 2017/0204575 | A1 | 7/2017 | Klein | |
| 2018/0172204 | A1 * | 6/2018 | Grappe | A47C 4/38 |
| 2020/0063387 | A1 * | 2/2020 | Klein | E01F 13/022 |
| 2020/0071141 | A1 * | 3/2020 | Kritzer | B66F 7/0683 |
| 2020/0173121 | A1 * | 6/2020 | Klein | E01F 13/12 |

FOREIGN PATENT DOCUMENTS

| | | | | |
|---|---|---|---|---|
| CN | 106351146 | A * | 1/2017 | E01F 13/12 |
| CN | 106468049 | A | 3/2017 | |
| DE | 202018103084 | U1 * | 10/2018 | E01F 13/12 |
| EP | 0724999 | A2 * | 8/1996 | |
| EP | 3323942 | A1 | 5/2018 | |
| EP | 3378992 | A1 | 9/2018 | |
| EP | 3486373 | A1 * | 5/2019 | E01F 13/02 |
| EP | 3575493 | A1 | 12/2019 | |
| FR | 3082532 | A1 | 12/2019 | |
| JP | 2007319357 | A * | 12/2007 | |
| KR | 20140104705 | A * | 8/2014 | A47B 23/043 |
| WO | 2018018796 | A1 | 2/2018 | |
| WO | 2018172238 | A1 | 9/2018 | |
| WO | WO-2020170282 | A1 * | 8/2020 | E01F 13/12 |

* cited by examiner

PROTECTION DEVICE AGAINST TRUCK RAMMING ATTACKS

FIELD

The present disclosure relates to lightweight barriers for protection from terrorist truck ramming attacks.

INTRODUCTION

Recent years have seen an increase in terrorist attacks in the West. This surge in terrorist acts has also been marked by a diversification in the means used in Europe, with the emergence in particular of the use of heavy goods vehicles as a weapon of terror.

There are heavy barriers that can reduce the risk of this type of attack, such as concrete barriers or metal posts securely anchored to the ground. However, this type of barrier requires either permanent installation or heavy logistics implying the use of a lifting device. This limitation is particularly acute with regard to securing temporary events, festivals, commercial fairs, concerts, etc. Furthermore, these temporary events appear to have today become favorite targets for terrorists.

One solution to this problem is provided for example by document US 2012/0177439 which proposes a lightweight barrier that can be set up, positioned and dismantled by just a few people having little in the way of tools and no lifting device. However, although these barriers are effective against lightweight vehicles, experience shows that they are not adequate to stop heavy vehicles such as those used recently by terrorists.

In prior art documents, the distance between adjacent modular elements is fixed by horizontal cross bars connecting each adjacent element. Such a system has several drawbacks. For example, it cannot be adapted to the way width and have a predetermined truck resistance. In many cases, it also has poor resistance against lateral attack such as attack at 45° (real lateral attack are usually hindered by street width and building boarding the street or place).

SUMMARY

The present disclosure aims to propose a device for protection from attacks using heavy goods vehicles, which device should be lightweight and easy to use by law enforcement having little in the way of tools.

It should also be easily adaptable to practical situation both in terms of truck resistance and in terms of lateral dimensions.

The present disclosure relates to an anti-ramming truck barrier element comprising:

- an essentially horizontal arresting bar;
- an essentially vertical pivot bar comprising at least three fasteners distributed along the length of each side of said pivot bar (i.e. three fasteners are on the right side and three fasteners are on the left side of the pivot bar), the arresting bar being rigidly connected to the pivot bar; and
- connecting bars pivotably connected to the side of the pivot bar, said connecting bars being adapted to be cross-connected at different crossing angles to adjacent pivot bars by means of the at least three fasteners distributed along the length of each side of said pivot bar.

According to preferred embodiments of the present disclosure, the anti-ramming truck barrier element comprises one or an appropriate combination of several of the following features:

- a first and a second connecting bar are preassembled on one side of the pivot bar, one of the extremity of the first connecting bar being fastened to one of the fasteners on the side of the pivot bar, and the second connecting bar being pivotably attached to the first connecting bar trough an axis at the center of both connecting bars, the unconnected extremities of the connecting bars being adapted to be fastened to free side fasteners of the of the pivot bar or to free fasteners of adjacent pivot bars;
- the pivot bar forming, with the arresting bar, an angle of at least 100° in a vertical plane;
- the device comprises anchoring means comprising essentially vertical spikes that are able to penetrate the surface of the ground when the wheel of a truck presses on the arresting bar;
- the device comprises additional anchoring means comprising a spike that is able to penetrate the surface of the ground when the device pivots as a consequence of a truck hitting the pivot bar;
- the pivot bar form an angle of between 100 and 135° with respect to the arresting bar;
- the arresting bar, when the device is set up on a flat horizontal surface, are slightly inclined, the pivot bars forming an angle of at least 100° with respect to the horizontal, the inclination being preferably obtained by means of supports located close to the center of gravity of the arresting bar/pivot bar assembly so as to facilitate pivoting of the assembly;
- the arresting bar is removably fitted into connector into which the pivot bar is removably fitted, the connector maintaining, in use, a fixed angle of greater than 100° between the arresting bars and the pivot bars,
- additional connecting bars are pivotably connected to the side of the arresting bar, the arresting bar comprising at least three fasteners distributed along the length of each side of said arresting bar, said connecting bars being adapted to be cross-connected at different crossing angles to adjacent arresting bars by means of the at least three fasteners distributed along the length of each side of said arresting bar.

A second aspect of the present disclosure relates to an anti-ramming truck barrier comprising several anti-ramming truck device elements according to the first aspect, adjacent elements being attached together by the corresponding connecting bars connected to the said fasteners.

Additional preferred details of the general setup of such barriers can be found in document EP3378992, which is hereby incorporated by reference.

Figure 1:
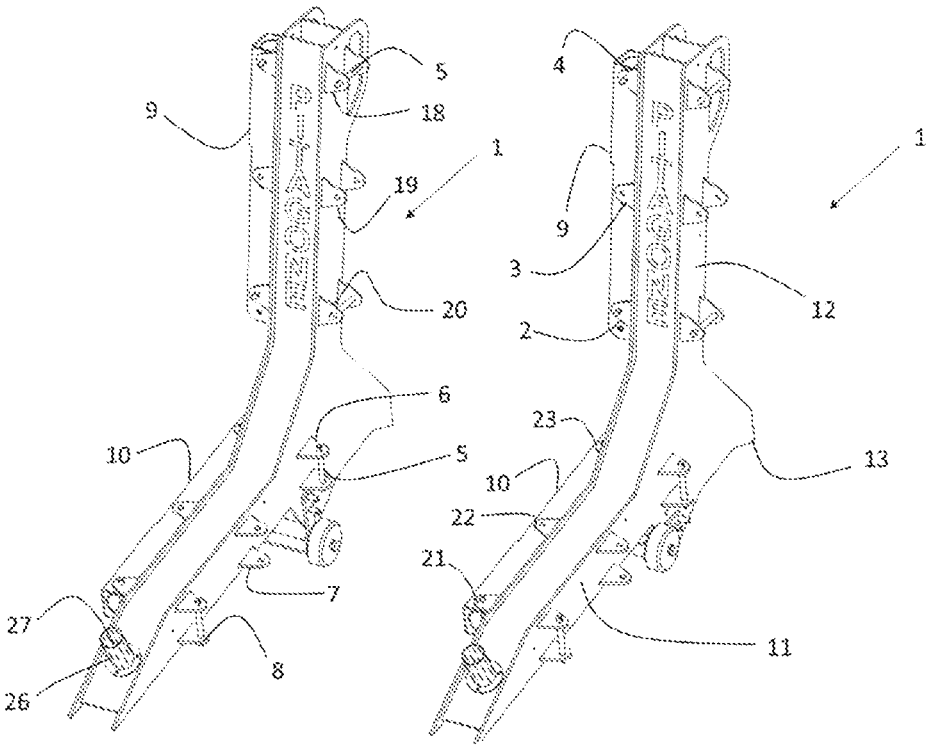
FIG. 1 shows a perspective view of two exemplary anti-ramming truck barrier elements according to the present disclosure.

FIGURE KEYS 1. anti-ramming truck barrier element
2, 3, 4, 18, 19, 20 Pivot bar fasteners for fixing connecting bars end
5. fixing stud
6, 7, 8, 21, 22, 23 arresting bar fasteners for fixing additional connecting bars end.
9. First connecting bar
10. first additional connecting bar
11. arresting bar
12. pivot bar
13. stopping spike
14. second connecting bar
15. second additional connecting bar
16. axis between first and second connecting bar
17. axis between first and second additional connecting bar
24. support and tipping spike
25. retractable wheel
26. soft arresting spike protection
27. arresting spike

DETAILED DESCRIPTION

Figure 2:
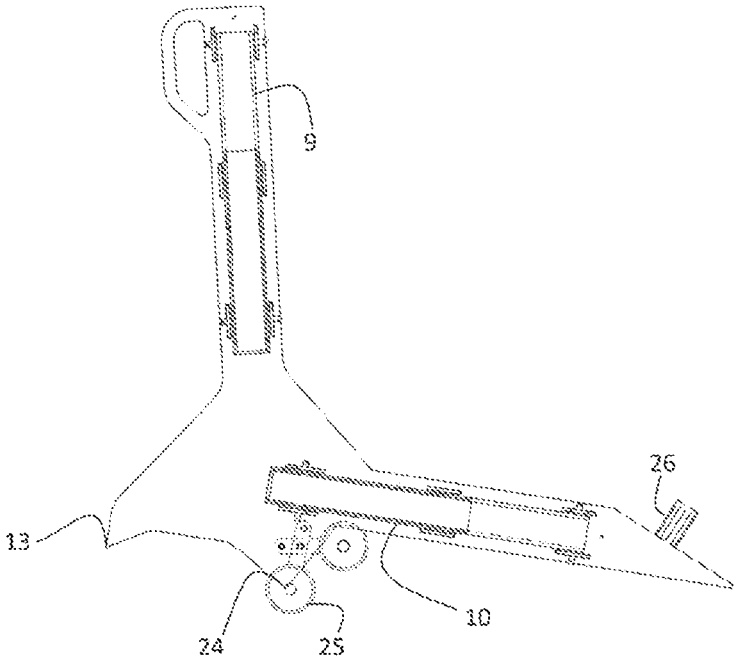
FIG. 2 shows a side view of an example of anti-ramming truck barrier element according to the present disclosure.
Figure 3:
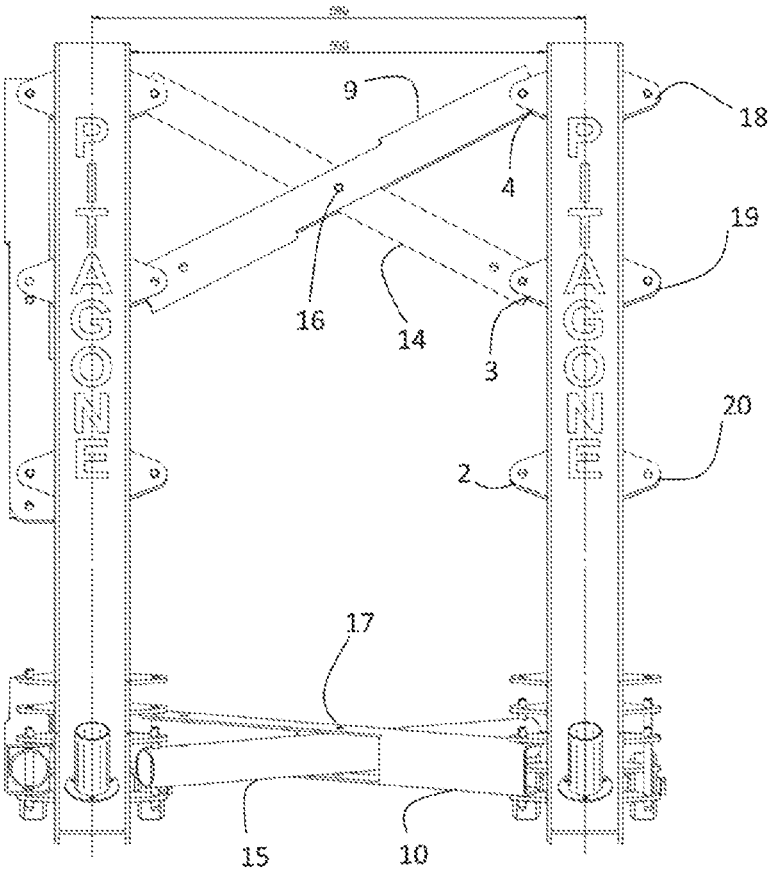
FIG. 3 shows a front view of two assembled barrier elements having their maximum separating distance.
Figure 4:
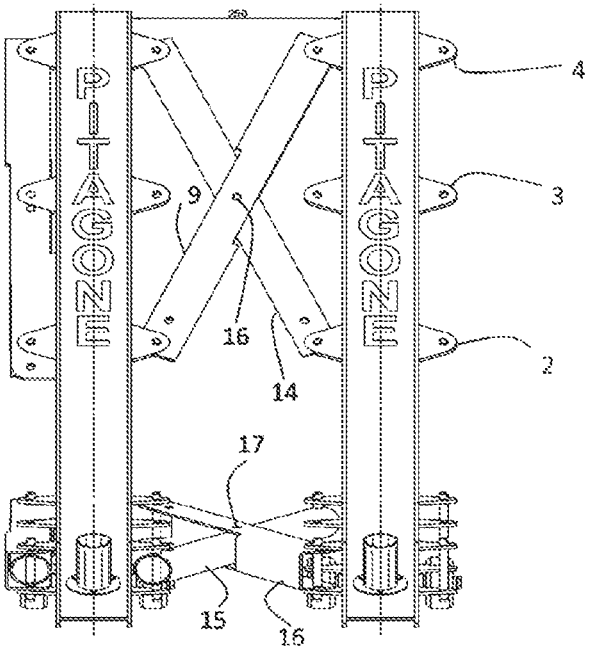
FIG. 4 shows a front view of two assembled barrier elements having their minimum separating distance.

As shown in FIGS. 1 to 3, the present disclosure relates to an anti-ramming truck barrier element comprising essentially horizontal arresting bars 11 fixed to pivot bars 12 (i.e. bars causing the device to pivot around a point fixed in the ground such as the stopping spike 13) forming preferably, with the arresting bars 11, an angle $\alpha$ of at least 100°.

Essentially horizontal is to be understood as meaning that these bars are intended to be laid on the ground, one of the two ends being laid on the ground and the other end being either laid on the ground or slightly raised.

The barrier elements 1 of the present disclosure are adapted to be assembled together with connecting bars 9,10,14,15. Those connecting bars are adapted to be cross connected at different angles between adjacent barrier elements, so that the distance between elements can be varied.

One advantage of such distance variability is that the mounted barrier can be adapted to different threat levels (i.e. truck weight and speed), the barrier being stronger when the distance is minimum and weaker when the distance is maximum.

A further advantage of the present disclosure is that by varying the distance between adjacent elements, the strength of the barrier can be fine-tuned for example by alternating wide and narrow distance between elements.

Another advantage is that the mounted barrier width can be adapted to the way width easily. As a further advantage, the strength of the barrier can be varied along the width of the barrier: for example, three elements in the middle of the barrier are assembled at minimum distance, and the elements on the side are assembled at maximum distance so as to cover the entire available width.

The most important connecting bars are those fastening the pivot bars 12, as they also help stabilizing the vertical position of each element in a barrier. These are the connecting bars 9,10 affixed to at least one lateral side of the pivot bar of each element as seen in FIG. 1. Preferably, as represented in FIG. 1, when dismounted, the barrier elements have two connecting bars preassembled on one side of the pivot bar 12, the bars being rotatably fixed together by an axis 16 passing through their centers. One of the preassembled bars is then rotatably fixed to a fastener 4.

In order to vary the angle between cross-connected connecting bars, each side of the pivot bars comprises a plurality (at least 3) of fasteners 2,3,4,18,19,20 wherein the extremity of the connecting bars 9,10 can be secured.

As shown in the FIGS. 1-3, the same cross-connection system can be applied between the arresting bars 11.

In contrast with some prior art that seeks to produce a vertical barrier that is held in that position by the weight of a vehicle on a base of the barrier, or that seeks to lift up the vehicle by means of a rotational movement of the barrier, preferred embodiments of the barrier elements of the present disclosure aims to use arresting bars 11 as stakes or spearheads that are on the one hand lodged in the ground by a spike 13 that penetrates the surface of the ground, and on the other hand lodged in the underside of the body of the vehicle by the impact of the vehicle with the elements of the device of the present disclosure.

Indeed, in the case of a heavy goods vehicle, it is ridiculous to suggest that the hinge of the devices of the prior art can have sufficient mechanical strength to stop a truck travelling at full speed. By contrast, a stake lodged in the underside of the body, rather than lifting up the truck, allows the greatest possible amount of kinetic energy to be absorbed, and the truck to be stopped more efficiently. It is then clear that the more horizontal the stake (opposite the direction of movement) during the arresting phase, the more effective the system.

In order to arrive at this result, the device of the present disclosure seeks to facilitate pivoting of each element of the barrier. To that end, rather than using a vertical barrier, the pivot bars 12 are fixed to the arresting bars 11 at an angle of at least 100°, that is to say at least 10° greater than the angle of the prior art barriers. This angle is preferably between 100 and 135°. This inclination has two consequences. First, this inclination moves the center of gravity of the assembly backward, thus facilitating pivoting of the device; second, this angle makes it possible to increase the torque of rotation applied by the front of the truck on the system.

Advantageously, anchoring means comprising a spike 13 that is able to penetrate the surface of the ground when the device pivots as a consequence of a truck hitting the barrier are arranged at the end of or in line with the arresting bars in order to improve the stake effect thereof.

Advantageously, the arresting bars 11, when the device is set up on a flat horizontal surface, are slightly inclined, the pivot bars 12 forming an angle of at least 100° with respect to the horizontal, this inclination being preferably obtained by means of supports 24,25 located slightly forward of the center of gravity of the arresting bar 11/pivot bar 12 assembly or assemblies so as to facilitate pivoting of the assemblies.

The said supports can be in the form of small wheels 25 facilitating the displacement of the barrier. In that case, the position of those wheels 25 are critical and should be very close to the vertical position of the center of gravity of the barrier elements, so that the rotation is easily obtained by the inertial behavior of the barrier when hit by a fast vehicle.

Preferably, the said wheels 25 can be retracted and leave the arresting bar resting on a spike 24 protruding from the bottom side of the arresting bar 11. In that case, the position of the spike 24 is less critical, as the friction forces between the spike and the ground would help the rotation movement.

In addition to those aspects of the device making it effective in terms of stopping ability, the device of the present disclosure must also be easy to set up and dismantle by a limited number of persons. To that end, the device can preferably be dismantled, the arresting bars 11 being removably fitted into connectors into which the pivot bars 12 are removably fitted, the connectors maintaining a fixed angle of greater than 100° between the arresting bars 11 and the pivot bars 12.

The invention claimed is:

1. An anti-ramming truck barrier element comprising:

a horizontal arresting bar;

a vertical pivot bar comprising a front side, a rear side, and two lateral sides, at least three fasteners being distributed along a length of the two lateral sides of the pivot bar, wherein the arresting bar is rigidly connected to the pivot bar; and at least two connecting bars each configured to be pivotably connected to the pivot bar and to an adjacent pivot bar of an adjacent barrier element, wherein the at least two connecting bars are each configured to be cross-connected between the pivot bar and the adjacent pivot bar at different crossing angles relative to each other using the at least three fasteners, such that a distance between the barrier element and the adjacent barrier element is selectively adjustable.

2. The anti-ramming truck barrier element according to claim 1 wherein the connecting bars comprise a first connecting bar and a second connecting bar preassembled on one of the lateral sides of the pivot bar, one extremity of the first connecting bar being fastened to one of the fasteners on the pivot bar, and the second connecting bar being pivotably attached to the first connecting bar through an axis at the center of both connecting bars, wherein unconnected extremities of the connecting bars being adapted to be fastened to free side fasteners of the pivot bar or to free fasteners of the adjacent pivot bar.

3. The anti-ramming truck barrier element according to claim 1, wherein the pivot bar forms, with the arresting bar, an angle of at least 100° in a vertical plane.

4. The anti-ramming truck barrier element according to claim 1, wherein the barrier element comprises an anchoring spike that is configured to penetrate a surface of the ground when the element pivots in response to a truck hitting the pivot bar.

5. The anti-ramming truck barrier element according to claim 1, wherein the pivot bar forms an angle of between 10° and 135° with respect to the arresting bar.

6. The anti-ramming truck barrier element according to claim 1, wherein the arresting bar, when the element is set up on a flat horizontal surface, is slightly inclined, the pivot bars forming an angle of at least 100° with respect to the horizontal, the inclination being obtained by supports located close to a center of gravity of the barrier element.

7. The anti-ramming truck barrier element according to claim 1, wherein the arresting bar is removably fitted into a connector into which the pivot bar is removably fitted, the connector maintaining, in use, a fixed angle of greater than 100° between the arresting bar and the pivot bar.

8. The anti-ramming truck barrier element according to claim 1, wherein one or more additional connecting bars are pivotably connected to a lateral side of the arresting bar, the arresting bar comprising at least three fasteners distributed along the length of said arresting bar, said one or more additional connecting bars being adapted to be cross-connected at different crossing angles to an adjacent arresting bar of the adjacent barrier element.

9. The anti-ramming truck barrier element according to claim 8 wherein the one or more additional connecting bars comprise a first additional connecting bar and a second additional connecting bar preassembled on one lateral side of the arresting bar, one extremity of the first additional connecting bar being fastened to one of the fasteners on the arresting bar, and the second additional connecting bar being pivotably attached to the first additional connecting bar through an axis at the center of both connecting bars, wherein unconnected extremities of the additional connecting bars being adapted to be fastened to free side fasteners of the arresting bar or to free fasteners of the adjacent arresting bar.

10. An anti-ramming truck barrier comprising several of the anti-ramming truck barrier elements of claim 1, wherein adjacent barrier elements are configured to be attached to each other by the corresponding connecting bars connected to the fasteners.

11. An anti-ramming truck barrier according to claim 10, wherein a distance between the barrier element and the adjacent barrier element is variable.

12. The anti-ramming truck barrier element according to claim 1, wherein the at least three fasteners extend from one or both of the two lateral sides of the pivot bar.

13. An anti-ramming truck barrier element comprising:

a horizontal arresting bar;

a vertical pivot bar comprising a front side, a rear side, and two lateral sides, at least three fasteners being distributed along a length of the pivot bar, the arresting bar being rigidly connected to the pivot bar; and connecting bars pivotably connected to the pivot bar, said connecting bars being adapted to be cross-connected in use at different crossing angles to an adjacent other pivot bar by means of the at least three fasteners.

14. The anti-ramming truck barrier element of claim 13, wherein the connecting bars comprise a first connecting bar and a second connecting bar preassembled on one of the lateral sides of the pivot bar, one extremity of the first connecting bar being fastened to one of the fasteners on the pivot bar, and the second connecting bar being pivotably attached to the first connecting bar through an axis at the center of both connecting bars, wherein unconnected extremities of the connecting bars being adapted to be fastened to free side fasteners of the pivot bar or to free fasteners of an adjacent other pivot bar.

15. The anti-ramming truck barrier element of claim 13, wherein the barrier element comprises an anchoring spike that is configured to penetrate a surface of the ground when the element pivots as a consequence of a truck hitting the pivot bar.

16. The anti-ramming truck barrier element of claim 13, wherein the pivot bar forms an angle of between 10° and 135° with respect to the arresting bar.

17. The anti-ramming truck barrier element of claim 13, wherein the arresting bar, when the element is set up on a flat horizontal surface, is slightly inclined, the pivot bars forming an angle of at least 100° with respect to the horizontal, the inclination being obtained by supports located close to a center of gravity of the barrier element.

18. The anti-ramming truck barrier element of claim 13, wherein the arresting bar is removably fitted into a connector into which the pivot bar is removably fitted, the connector maintaining, in use, a fixed angle of greater than 100° between the arresting bar and the pivot bar.

19. The anti-ramming truck barrier element of claim 13, wherein one or more additional connecting bars are pivotably connected to the lateral side of the arresting bar, the arresting bar comprising at least three fasteners distributed along the length of said arresting bar, said one or more additional connecting bars being adapted to be cross-connected at different crossing angles to an adjacent other arresting bar.

20. An anti-ramming truck barrier element comprising:

a horizontal arresting bar;

a vertical pivot bar comprising a front side, a rear side, and two lateral sides, wherein at least three fasteners are distributed along a length of the two lateral sides of the pivot bar, and wherein the arresting bar is rigidly connected to the pivot bar;

a plurality of connecting bars pivotably connected to the pivot bar, wherein the connecting bars are each configured to be cross-connected at different crossing angles to an adjacent other pivot bar using the at least three fasteners; and an anchoring spike configured to penetrate a surface of the ground when the barrier element pivots from a non-engaged position to an engaged position in response to a vehicle impacting the front side of the pivot bar;

wherein, when the barrier element is in the non-engaged position, the anchoring spike is disposed rearward and below the pivot bar.

* * * * *